US009777939B2

(12) United States Patent
Zuo et al.

(10) Patent No.: US 9,777,939 B2
(45) Date of Patent: Oct. 3, 2017

(54) RETRACTABLE STRUCTURE FOR AIR-CONDITIONING VENT

(71) Applicant: NINGBO RUNNER INDUSTRIAL CORPORATION, Zhejiang (CN)

(72) Inventors: Hua-Liang Zuo, Zhejiang (CN); Mao-Li Song, Zhejiang (CN); Hong-Tao Yang, Zhejiang (CN); Yu-Jie He, Zhejiang (CN); Bin Xiao, Zhejiang (CN)

(73) Assignee: NINGBO RUNNER INDUSTRIAL CORPORATION, Ningbo (CN)

( * ) Notice: Subject to any disclaimer, the term of this patent is extended or adjusted under 35 U.S.C. 154(b) by 472 days.

(21) Appl. No.: 14/093,496

(22) Filed: Dec. 1, 2013

(65) Prior Publication Data

US 2014/0302771 A1 Oct. 9, 2014

(30) Foreign Application Priority Data

Apr. 7, 2013 (CN) ..... 2013 2 0167531

(51) Int. Cl.
*F24F 7/00* (2006.01)
*F24F 13/06* (2006.01)
*F24F 13/08* (2006.01)

(52) U.S. Cl.
CPC ..... *F24F 13/084* (2013.01); *F24F 13/06* (2013.01); *F24F 2221/14* (2013.01)

(58) Field of Classification Search
CPC ..... F24F 13/06; F24F 13/084; F24F 13/20; F24F 2221/14
USPC ..... 454/331, 248, 284, 300, 310; 248/220.21, 221.11, 222.11, 222.12, 248/223.41, 224.8, 228.7, 231.81
See application file for complete search history.

(56) References Cited

U.S. PATENT DOCUMENTS 2,392,393 A * 1/1946 Kennedy ..... F24F 13/06 454/310
2,858,760 A * 11/1958 Lathrop ..... F24F 13/062 181/198
6,132,245 A * 10/2000 Wertz ..... H01R 13/743 439/268
7,530,705 B2 * 5/2009 Czech ..... F21S 8/02 248/288.11

FOREIGN PATENT DOCUMENTS

CN 2018669000 U 6/2011

* cited by examiner

*Primary Examiner* — Helena Kosanovic
(74) *Attorney, Agent, or Firm* — Chun-Ming Shih

(57) ABSTRACT

A retractable structure for air-conditioning vent has a retractable mechanism capable of retractably installing a vane into an installing hole of a main body. The retractable mechanism includes a plurality of connecting plates on the main body, and an end of the connecting plates is limited on the main body, and the other end of the connecting plate is passed through a plug hole formed on the vane, and each connecting plate has a bracket on a corresponding side, and a middle portion of the bracket is coupled to the connecting plate, and a first bracket portion and a second bracket portion disposed on both sides of the middle portion of the bracket respectively are outwardly protruded and then inwardly bent to form a stopper portion to stop the plug hole from automatically sliding down.

2 Claims, 5 Drawing Sheets

RETRACTABLE STRUCTURE FOR AIR-CONDITIONING VENT

BACKGROUND OF THE INVENTION

1. Field of Invention

The present invention relates to a retractable structure for an air-conditioning vent.

2. Description of Related Art

As people's standard of living standard improves, central air-conditioning with the features of energy saving, fuel saving, convenient use, and low noise gradually replaces general air-conditioning and it is used extensively in places such as hotel, office and family. The central air-conditioning is mainly composed of four basic components, respectively: a compressor, a condenser, a throttle and an evaporator, and these components are connected sequentially by a pipeline to form a closed system, and a refrigerant is filled into the system and circulated in the system. Through a change of physical state, and a heat exchange with the outside, the temperature of air can be regulated. Wherein, the evaporator is connected to a vent of each room or a local space, so that the cooled or heated air can be delivered to the outside through the vent.

A vent device installed at a corner or on a wall or ceiling is generally divided into two main types, respectively: a retractable type and a fixed type, wherein the vent device with a retractable structure can save transportation volume and lower transportation cost, as well as adjusting the ventilation by changing the level of expansion or contraction according to requirements.

A ceiling vent retractable ring structure as disclosed in P.R.C. Pat. Publication No. CN201866900U is a retractable air-conditioning vent structure for ceilings. This retractable air-conditioning vent structure for ceilings comprises a main body and a ring, and the main body includes an installing hole formed thereon, and the ring is installed in the installing hole and includes a notch with a width capable of passing through the ring transversally, and a circumferential edge of the ring is bent outwardly to form a folded edge capable of stopping the ring in the installing hole, and the external periphery of the ring installed at a position proximate to the other circumferential edge of the ring has a rib for limiting the displacement of the ring. In the present invention, the ring is designed with an open structure. By means of a different-direction dislocating compression of the ring, the diameter of the ring can be reduced in order to install the ring into the installing hole of the main body. By means of the effect of the bent edge and the rib, the ring can be limited in the installing hole and will not fall out easily. Therefore, the ring can be compressed into the main body for packaging and transportation and pulled out form the main body for installation and use without affecting the normal application. Such invention can reduce the packaging volume and lower the transportation cost. The patented invention just limits the assembly of the main body and the ring only, but has not mentioned the structural relation among the vane, the main body and the ring. In the prior art, the ring and the main body are separated for the transportation and storage of the vane. The retractable structure involves more components and a more complicated structure, after the ring and the main body are assembled, and thus each part has a higher manufacturing and assembling precision requirement. In addition, the structure must be packaged separately for transportation and storage, and thus incurring higher transportation and storage costs.

SUMMARY OF THE INVENTION

Therefore, it is a primary objective of the present invention to overcome the problems of the prior art by providing a retractable structure for air-conditioning vent with low manufacturing accuracy and precision, high assembling efficiency and low transportation and storage costs.

To achieve the foregoing objectives, the present invention provides a retractable structure for air-conditioning vent having a retractable mechanism capable of retractably installing a vane into an installing hole of a main body, characterized in that the retractable mechanism comprises a plurality of connecting plates distributed uniformly on the main body, and an end of the connecting plates is limited on the main body, and the other end of the connecting plate is passed through a plug hole formed on the vane, and each connecting plate has a bracket on a corresponding side, and a middle portion of the bracket is coupled to the connecting plate, and a first bracket portion and a second bracket portion disposed on both sides of the middle portion of the bracket respectively are outwardly protruded and then inwardly bent to form a stopper portion to stop the plug hole from automatically sliding down.

To facilitate the assembling process, the connecting plate can further include a bottom plate coupled to the main body, and a connecting base perpendicular to the bottom plate, and the bracket is installed on the connecting base. Wherein, the bottom plate and the main body are connected with each other by a pivoting method, a screw thread connection, or any other equivalent connecting method.

For further improvements, the middle portion of the connecting base includes two latch plates, and the first bracket portion and the second bracket portion have corresponding latch holes, and the two latch plates are passed through the corresponding latch holes and bent in a direction towards the middle portion of the bracket, so as to clamp the middle portion of the bracket.

The structure of the present invention requires no additional materials or accessories for the connection of the bracket with the connecting base, and the two latch plates can be cut from the connecting base to save material.

To maintain a more secured spread-open status of the vane, the spread-open surface of the connecting base is in a T-shape and corresponsive to the middle portion of the bracket, and the middle portion of the connecting base is a flat structure, and the remaining portion of the connecting base has a cross-section substantially in an arc shape. Therefore, after the vane is pulled out from the main body, the protrusions on both sides of the connecting base can be abutted and stopped at an edge of the plug hole and will not be retracted into the main body by a wrong operation.

Compared with the prior art, the retractable structure for air-conditioning vent of the present invention adopts a combination of the connecting plate and the bracket to provide the required elasticity continuously to assure the stability of retracting and stretching the vane in the condition of relatively low manufacturing accuracy and precision, so as to avoid vibrations and noises produced by the vane and deformations occurred in a transportation process. In addition, the retractable mechanism comes with a simplified structure to achieve the effects of reducing the number of components, saving materials, simplifying the manufacturing procedure, and obtaining a high assembling efficiency. In the meantime, the combination of the bracket and the plug hole can provide a more comfortable stretching feeling to users.

BRIEF DESCRIPTION OF THE DRAWINGS

The technical characteristics and objectives of the present invention can be further understood by the following detailed description of preferred embodiments and related drawings in which.

DETAILED DESCRIPTION OF THE INVENTION

Figure 1:
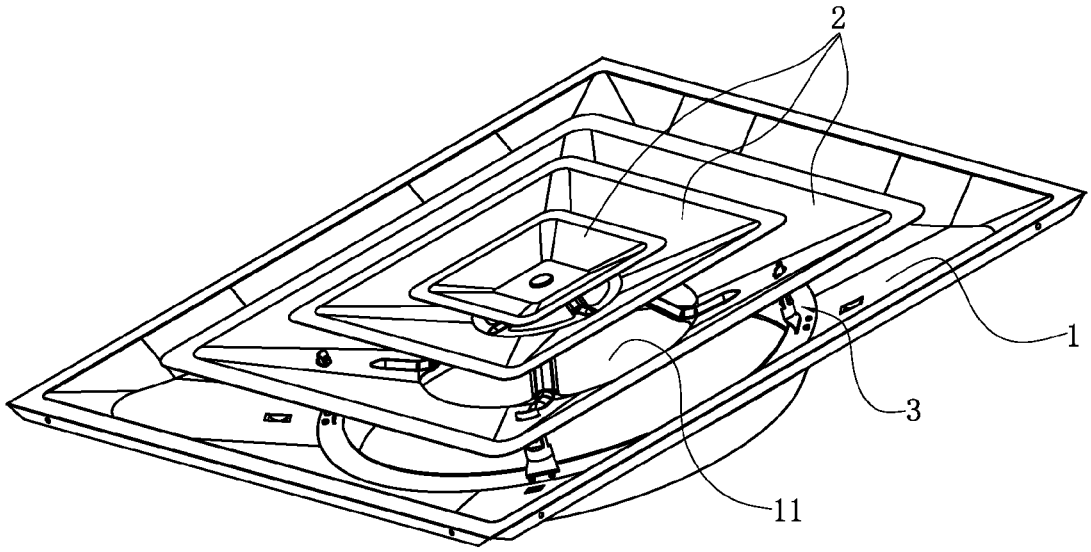
FIG. 1 is a perspective view of a using status of a retractable structure of the present invention.
Figure 2:
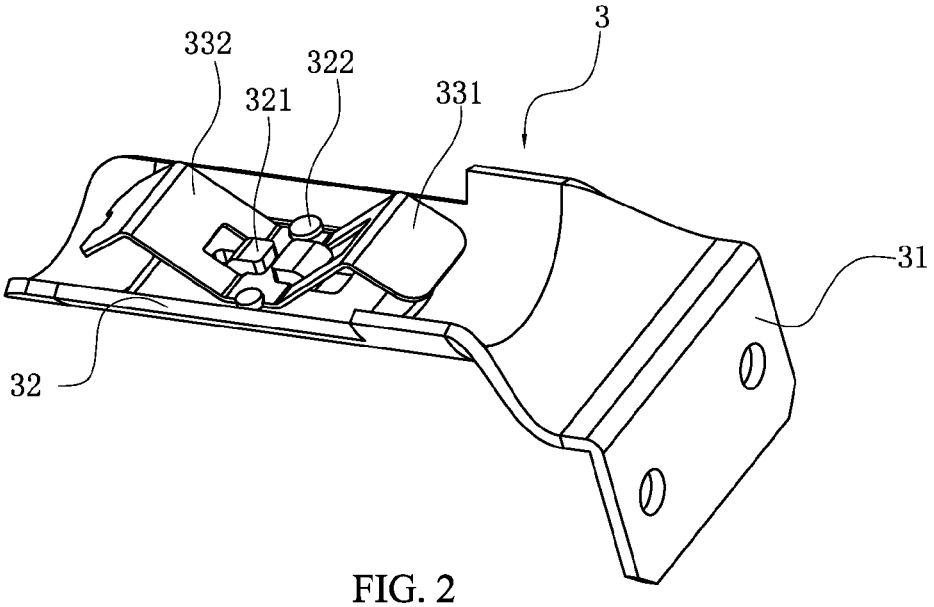
FIG. 2 is a perspective view of a retractable structure of a preferred embodiment of the present invention.
Figure 3:
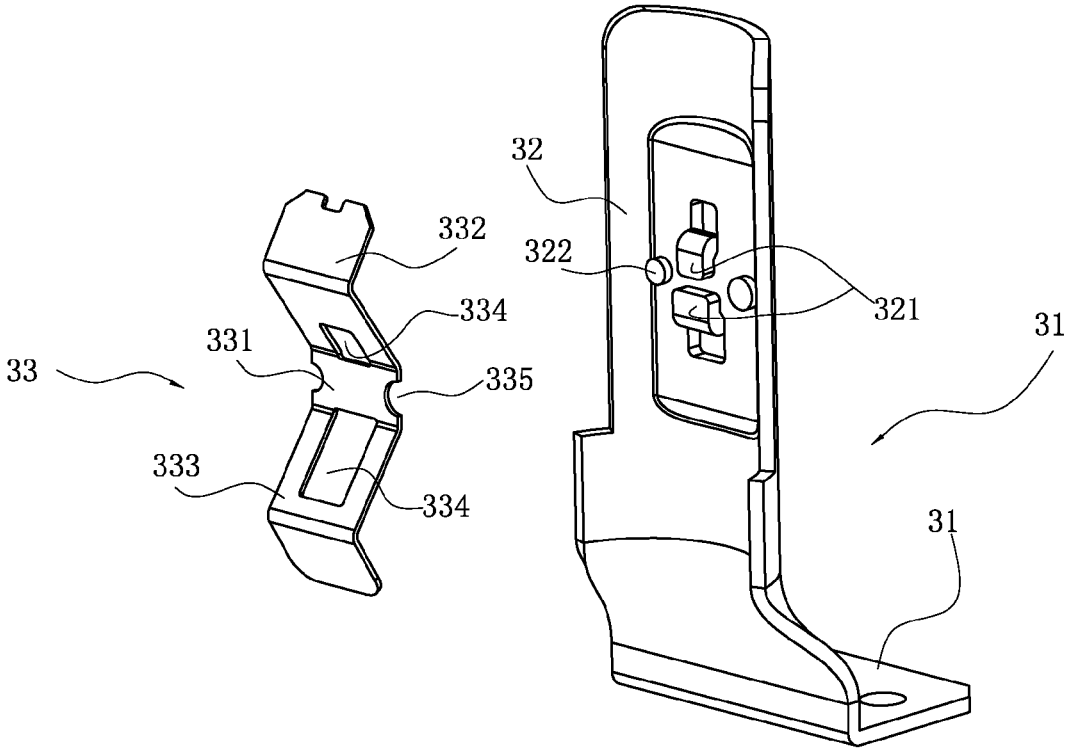
FIG. 3 is an exploded view of the retractable structure of FIG. 2.
Figure 4:
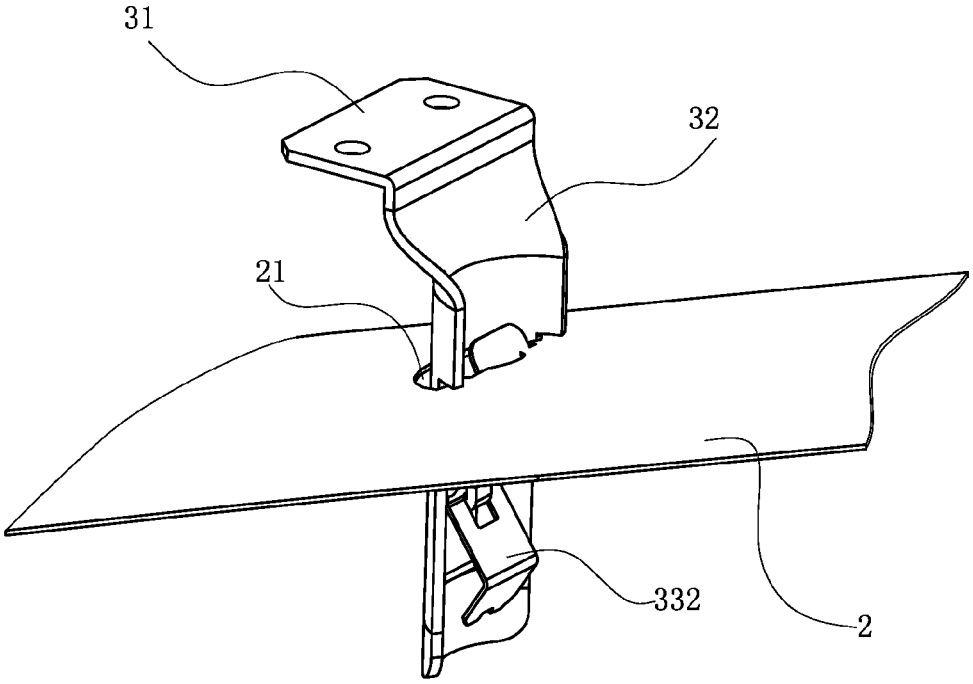
FIG. 4 is a schematic view of a using status of a retractable mechanism and a vane of a preferred embodiment of the present invention, when the vane is retracted.
Figure 5:
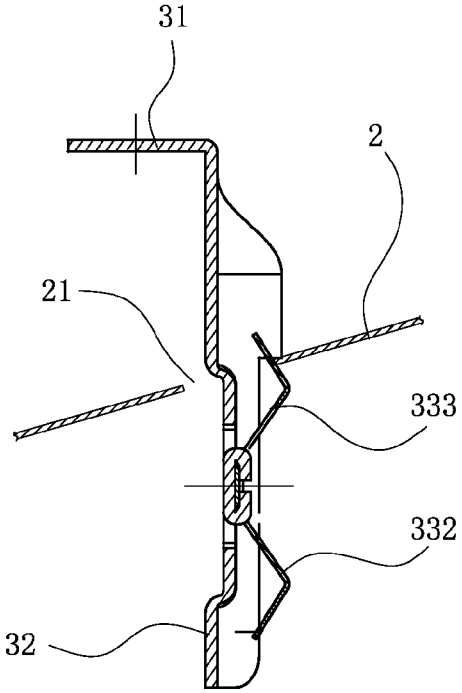
FIG. 5 is a longitudinal sectional view of FIG. 4.
Figure 6:
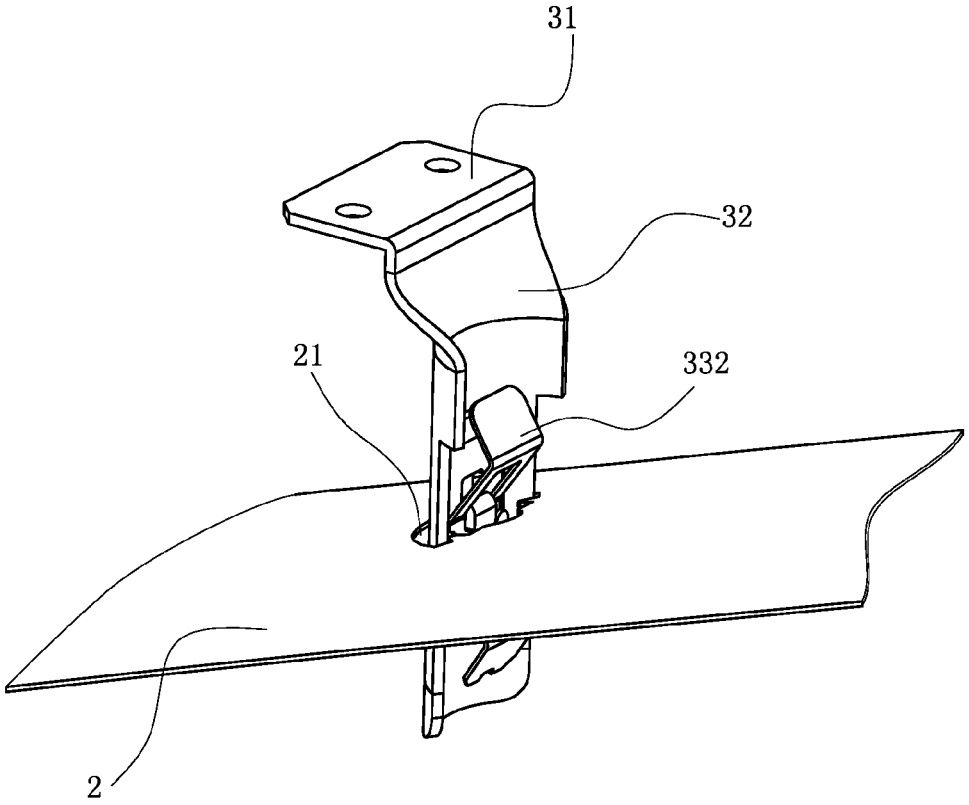
FIG. 6 is a schematic view of a using status of a retractable mechanism and a vane of a preferred embodiment of the present invention, when the vane is in a contracting and retracting process.
Figure 7:
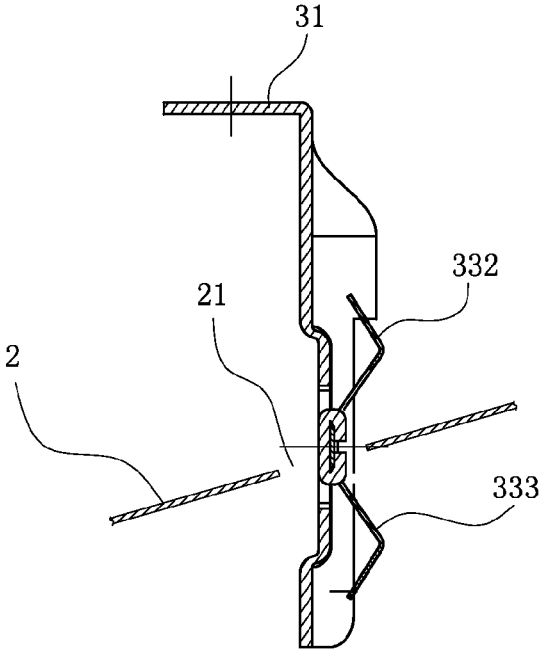
FIG. 7 is a longitudinal sectional view of FIG. 6.
Figure 8:
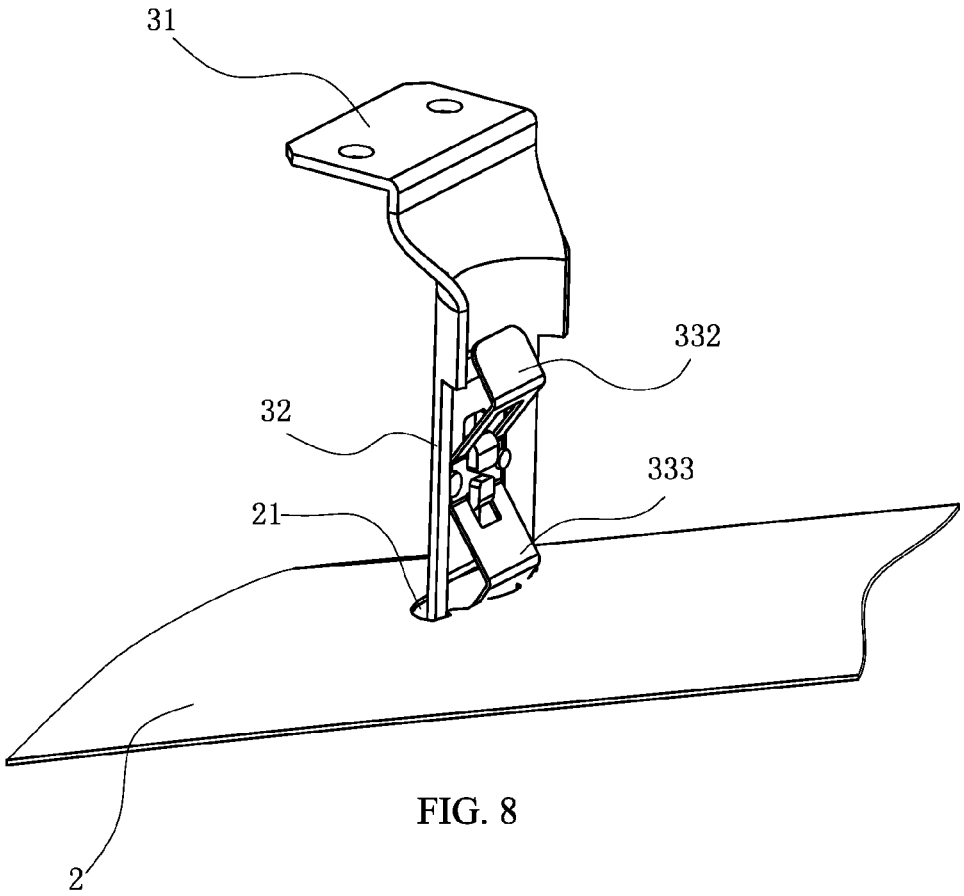
FIG. 8 is a schematic view of a using status of a retractable mechanism and a vane of a preferred embodiment of the present invention, when the vane is stretched.
Figure 9:
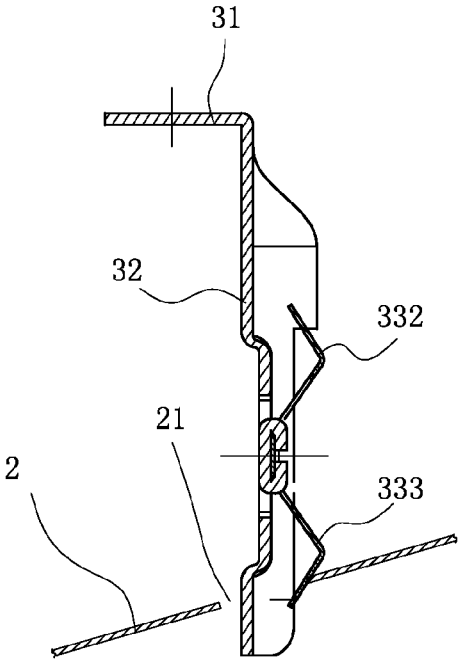
FIG. 9 is a longitudinal sectional view of FIG. 8.

With reference to FIGS. 1 to 9 of a retractable structure for an air-conditioning vent in accordance with the present invention, the vent includes a main body 1 mounted onto a wall, and the main body 1 has an installing hole 11, and the vane 2 corresponding to the installing hole 11 is installed onto the main body 1 through the retractable mechanism 3.

The retractable mechanism 3 comprises: a bottom plate 31, riveted on the main body 1; a connecting base 32, being perpendicular to the bottom plate 31, and having two latch plates 321 installed at a middle portion of the connecting base 32, and a spread-open surface (not numbered) of the connecting base 32 being in a T-shape, and the middle portion of the connecting base 32 being a flat structure, and the cross-section of the remaining portion of the connecting base 32 is in an arc shape (not shown).

The bottom plate 31 and the connecting base 32 constitute a connecting plate of this preferred embodiment.

The bracket 33 includes a flat middle portion 331, and a first bracket portion 332 and a second bracket portion 333 disposed on both sides of the middle portion 331 respectively. Both first bracket portion 332 and second bracket portion 333 are protruded outwardly and bent inwardly to form an external protruding corner structure. In addition, both first bracket portion 332 and second bracket portion 333 have a latch hole 334. The two latch plates 321 are passed through the corresponding latch holes 334 and then latched to the middle portion 331 of the bracket 33, so that the bracket 33 can be connected to the connecting base 32. In this preferred embodiment, the middle portion 331 of the bracket 33 further includes two cutouts 335 disposed symmetrically with each other, and the connecting base has two limit bumps 322 corresponding to the two cutouts 335. With a combination of the bumps 322 and the cutouts 335, the bracket 33 can be fixed onto the connecting base more securely.

In this preferred embodiment, there are three retractable mechanisms 3 distributed uniformly along the periphery defining the installing hole 11. Correspondingly, the vane has four corresponding plug holes 21.

The operating principle of the retractable structure is described as follows:

During transportation, the vane 2 is pressed inwardly, so that the plug hole 21 is situated at the middle portion 331 of the bracket 33. With the position limited by first bracket portion 332 and the second bracket portion 333, the vane 2 can be limited securely between the first bracket portion 332 and the second bracket portion 333 to prevent damages caused by vibrations occurred in the transportation process.

During use, the vane 2 is pulled and stretched outward, such that the first bracket portion 332 is compressed and squeezed by an edge of the plug hole 21 during the pulling and stretching process, and the external protruding corner is deformed, such that the plug hole 21 is disposed across the external side of the corner of the first bracket portion 332. Now, the protrusions on both edges of the connecting base 32 can be abutted and stopped by the edge of the plug hole 21, and the plug hole 21 is stopped at the corner of the first bracket portion 332.

After the vent is installed, users can repeat the aforementioned operation to retract the vane 2 into the installing hole 11 of the main body 1 or stretch the vane 2 from the interior of the main body 1 to the outside. The retracting or stretching operation is very convenient and has a good hand feel.

In summation of the description above, the present invention improves over the prior art and complies with the patent application requirements, and thus is duly filed for patent application.

What is claimed is:

1. A retractable structure for an air-conditioning vent, having a retractable mechanism capable of retractably installing a vane into an installing hole of a main body, characterized in that the retractable mechanism comprises a plurality of connecting plates distributed uniformly on the main body, and a bottom plate formed on each of the connecting plates is directly fixed to the main body, and a connecting base of each connecting plate is passed through a plug hole formed on the vane, and each connecting plate has a bracket on a corresponding side, and a middle portion of the bracket is fixed to a middle portion of the connecting plate; a first bracket portion and a second bracket portion are disposed on opposite sides of the middle portion of the bracket respectively; each of the first bracket portion and the second bracket portion are outwardly protruded and then inwardly bent to form an L-shaped stopper portion to stop the plug hole from automatically sliding down, wherein the connecting base perpendicularly extends from the bottom plate, and the bracket is installed on the connecting base;

wherein the middle portion of the connecting base includes two latch plates, and the first bracket portion and the second bracket portion have corresponding latch holes, and the two latch plates are passed through the corresponding latch holes and bent in a direction towards the middle portion of the bracket, so as to clamp the middle portion of the bracket.

2. The retractable structure for an air-conditioning vent according to claim 1, wherein the connecting base has a spread-open surface in a T-shape and corresponsive to the middle portion of the bracket, and the middle portion connecting base is a flat structure, and the cross-section of the remaining portion of the connecting base is in an arc shape.

* * * * *